US006283700B1

(12) United States Patent
Oltrogge

(10) Patent No.: US 6,283,700 B1
(45) Date of Patent: Sep. 4, 2001

(54) APPARATUS AND METHOD FOR DETACHING CABLES FROM A CENTER BEAM RAILCAR

(75) Inventor: John P. Oltrogge, Arvada, CO (US)

(73) Assignee: Safety Solutions, Inc., Arvada, CO (US)

( * ) Notice: Subject to any disclaimer, the term of this patent is extended or adjusted under 35 U.S.C. 154(b) by 0 days.

(21) Appl. No.: 09/598,819

(22) Filed: Jun. 21, 2000

Related U.S. Application Data

(60) Provisional application No. 60/140,237, filed on Jun. 22, 1999.

(51) Int. Cl.[7] ..... B66F 9/18

(52) U.S. Cl. ..... 414/607; 294/81.56; 410/98; 410/100

(58) Field of Search ..... 410/100, 98; 414/607; 297/81.56

(56) References Cited

U.S. PATENT DOCUMENTS

| | | | | |
|---|---|---|---|---|
| 2,558,388 | | 6/1951 | Richardson . | |
| 2,644,598 | * | 7/1953 | Winslow | 414/607 |
| 3,053,405 | * | 9/1962 | Holmberg, Jr. et al. | 414/607 |
| 3,930,585 | | 1/1976 | Lynch . | |
| 4,160,509 | | 7/1979 | Switzer . | |
| 5,024,567 | | 6/1991 | Dominguez | 410/100 |
| 5,186,586 | | 2/1993 | Stephenson, Jr. | 410/100 |
| 5,460,465 | | 10/1995 | Little | 410/100 |
| 5,486,083 | * | 1/1996 | Thompson | 414/607 |
| 5,626,083 | | 5/1997 | Saxton | 105/355 |
| 5,876,164 | | 3/1999 | Hamelin et al. . | |
| 5,899,646 | | 5/1999 | Tatina | 410/100 |

FOREIGN PATENT DOCUMENTS

| | | | | |
|---|---|---|---|---|
| 2444580 | * | 1/1976 | (DE) | 414/607 |
| 4136285 | * | 5/1993 | (DE) | 294/81.56 |
| 1193943 | * | 11/1959 | (FR) | 414/607 |
| 937503 | * | 9/1963 | (GB) | 414/607 |
| 581077 | * | 11/1977 | (RU) | 294/81.56 |

* cited by examiner

*Primary Examiner*—Steven A. Bratlie
(74) *Attorney, Agent, or Firm*—Stuart T. Langley; Kent A. Lembke; Hogan & Hartson, L.L.P.

(57) ABSTRACT

A tool for removing tie down cables from a center beam rail car loaded with cargo, the apparatus comprising a support beam having a width selected to be greater than the span between a number of tie down cables on the center beam rail car. A plurality of hook-shaped cable claws are rigidly attached in a spaced apart, downwardly extending manner to the support beam. At least one lift sleeve rigidly attached to the support beam and having a receiving end for attaching to an external lift mechanism.

23 Claims, 12 Drawing Sheets

APPARATUS AND METHOD FOR DETACHING CABLES FROM A CENTER BEAM RAILCAR

RELATED APPLICATIONS

Claim for priority is made under 35 U.S.C. 119 or 35 U.S.C. 120 to co-pending U.S. provisional patent application Ser. No. 60/140,237, Filed Jun. 22, 1999.

BACKGROUND OF THE INVENTION

1. Field of the Invention

The present invention relates, in general, to railroad freight cars, and, more particularly, to an apparatus, system and method for unloading railcars having a center beam structure extending along the length of the car body.

2. Relevant Background

Center beam railcars have been used for a number of years to carry cargo such as lumber, building materials, and generally any cargo that can be packaged in packages of substantially uniform size and shape. Center beam railcars offer advantages of lower size and weight, and therefore can carry greater cargo weight. This feature results in greater efficiency in transport, greater fuel efficiency as compared to conventional boxcar designs.

Generally, a center beam railcar comprises a flatbed-like railcar usually with bulkheads on both front and back ends of the car. The center beam railcar has substantially no sidewalls or roof structure. A center beam or partition structure runs along the length of the car extending upwardly from the deck. The center beam structure provides for the static and dynamic loads associated with the cargo during transport.

Center beam railcars have an integral cable-stayed load tie-down system. At an upper portion of the center beam a mounting structure is formed or attached that includes a plurality of keyhole slots for attaching cables, straps, or other means of securing the load. To unload a center beam railcar a person must climb atop the railcar to release the cable tie-down system from the keyhole slots. This operation presents a significant safety hazard as personnel can easily fall from the top of the railcar. This is particularly true when the operation must be performed in rain, snow, or other adverse conditions. Another disadvantage is that the cables and components of the tie down system can easily fall from the car presenting significant risk of injury to people positioned below the car.

This safety problem has been addressed with stopgap measures awaiting a more permanent solution. For example, the task can be performed by an operator protected from falling by a cage suspended by a forklift. This solution makes the task of releasing the cable-tie more cumbersome and time consuming. Moreover, two operators are required for the task rather than one operator as intended. A need exists for a method of releasing the cable tie system that improves safety while allowing rail yard operators to efficiently unload center beam type railcars.

SUMMARY OF THE INVENTION

Briefly stated, the present invention involves a method, apparatus, and system for uncabling a center beam flatcar. In transport, a load is retained on the railcar using a tie down assembly attached to key holes of an upper rail of the flatcar. In accordance with the present invention a cable removing apparatus is operated by loosening cable tie downs to create cable slack, then attaching the cable removing apparatus in accordance with the present invention to a lift mechanism having a plurality of cable claws located distally from the lift mechanism. The cable claws are positioned so that tip ends of the cable claws are adjacent to the loosened cables and clear of a load carried in the railcar. The cable claws are shifted sideways in the direction of the cables such that the tip ends enter a loop created by the cable slack. Using the lift mechanism, the cable claws are raised to engage the cables and lift the cable claws above the upper rail of the center beam. The cable claws are moved towards the upper rail of the center beam flatcar until all of the cables engaged by one of the cable claws are released from the keyholes in the upper rail. The cable claws are moved away from the upper rail until the cables are pulled free of the railcar and fall to the ground.

A cable removing apparatus in accordance with the present invention includes a plurality of hook shaped cable claws that are rigidly coupled in a spaced apart, aligned fashion to a support beam. The cable claws are spaced from each other by a spacing substantially similar to cable-to-cable spacing in center beam flatcars. The support beam is coupled to one or more lift sleeves having a receiving end for removably attaching to an external lift mechanism. Optionally, a safety gate is attached by hinges to the cable removing apparatus near the receiving end of the lift sleeves to protect a lift operator from falling cables during operation.

A cable removing system in accordance with the present invention is designed to enable a single operator using a lift mechanism such as a forklift to remove cable ties securing a load to a center beam flatcar. The system in accordance with the present invention includes a cable removing mechanism that removeably attaches to a lift mechanism such as a forklift or overhead crane. The cable removing apparatus includes a plurality of spaced apart aligned cable hooks positioned at a first end and a lift mechanism receiver located at a second end. The cable hooks extend downwardly a sufficient distance to engage a loosened cable tie down from above the load.

DETAILED DESCRIPTION OF THE PREFERRED EMBODIMENTS

Figure 1:
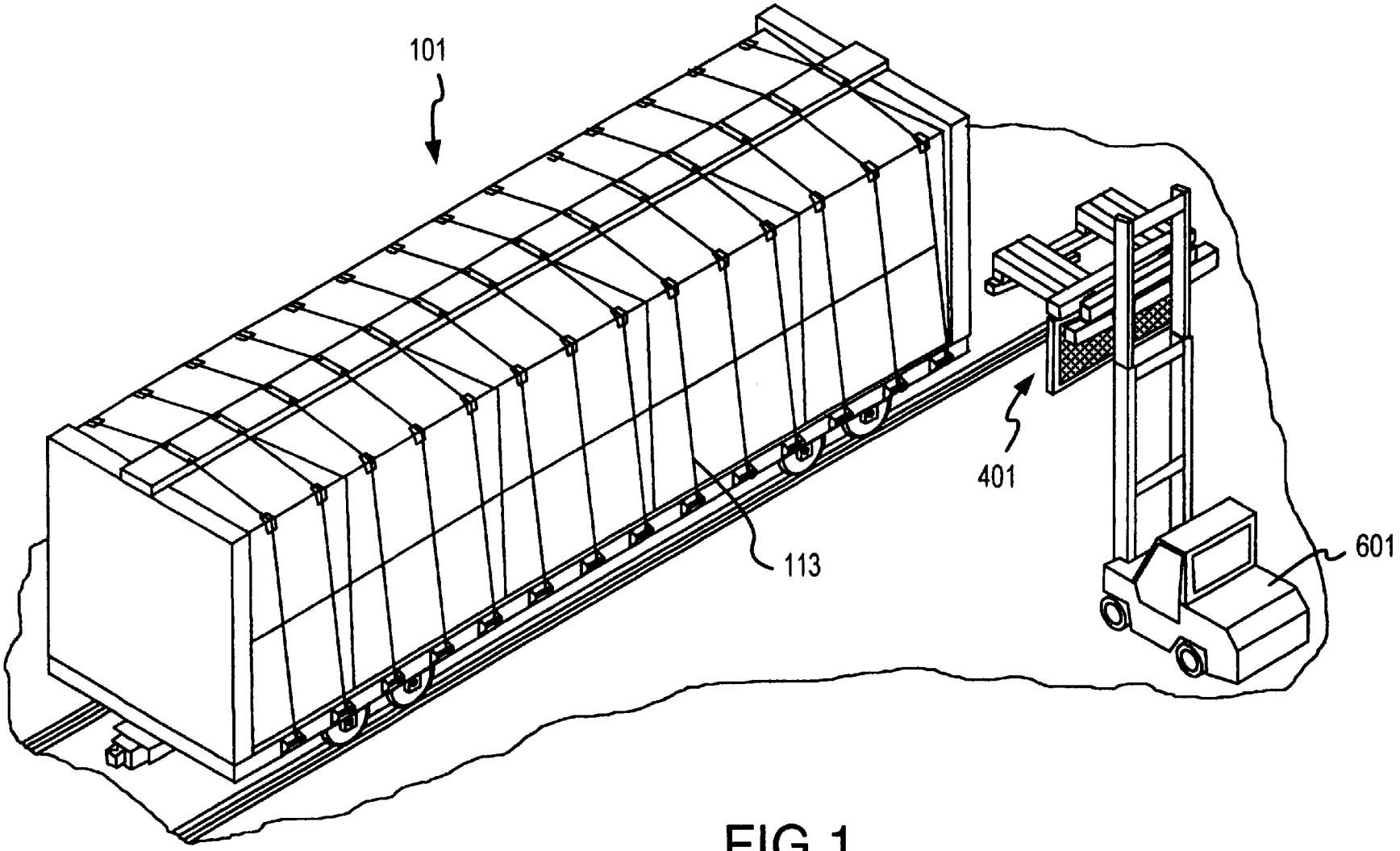
FIG. 1 shows an overview of the system and method in accordance with the present invention.

The present invention addresses the deficiencies of the prior art by providing a system that enables a single freight yard operator to safely and efficiently disengage the cable tie downs on a center beam flatcar. FIG. 1 illustrates an overview of the present invention in which an operator (not shown) using fork lift 601 and the cable removing mechanism 401 in accordance with the present invention can detach cables 113 from a loaded center-beam freight car 101.

Figure 2:
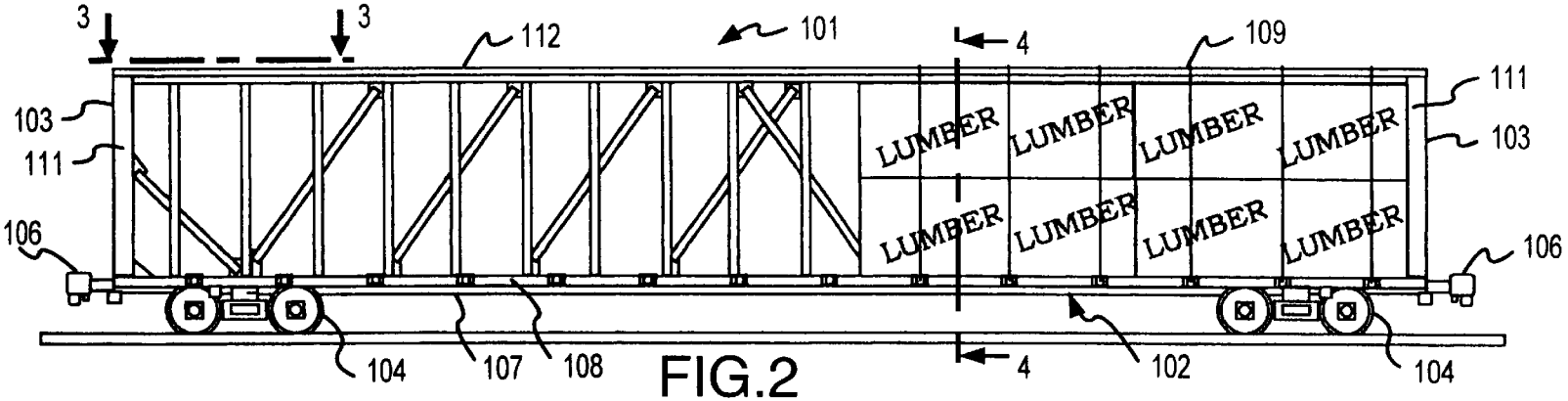
FIG. 2 shows a side view of an exemplary center beam flatcar.

An exemplary center beam car 101 for use in the present invention is shown in FIG. 1 and in side view in FIG. 2, although the present invention is readily adaptable to a variety of freight car designs. Car 101 includes a car body 102 having a pair of opposite ends 103. Car body 102 is constructed, for example, of structural steel tubing and sheet steel and carried on a pair of conventional wheeled trucks 104. A coupler 106 is typically provided on each end 103. In a typical application car 101 would include a variety of accessories such as ladders, brake wheels, supports, and the like that are not shown to ease understanding of the present invention.

Car 101 includes a longitudinally extending center sill 107 (best seen in FIG. 4) and a pair of side sills 108 extending longitudinally of car body 102 on either side of center sill 107. A center beam structure 109 extends upward above the center sill 107 and extends longitudinally on a upper portion of the car body 102 between a pair of upwardly extending bulkheads 111 located at ends 103.

Figure 3:
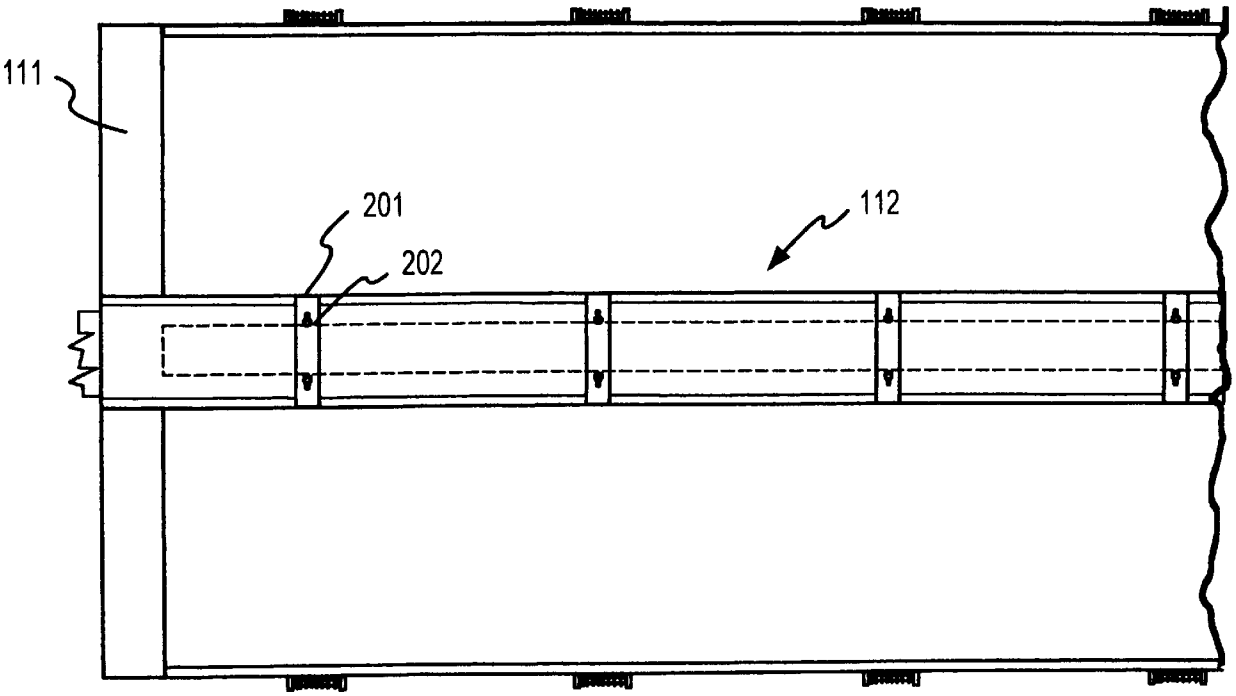
FIG. 3 shows a top-down view of an upper rail of the center beam flatcar shown in FIG. 1.

FIG. 3 illustrates a portion of an example of an upper rail 112 in greater detail. Upper rail 112 is attached using any available securing means (e.g., welds, bolts, flanges, and the like) to the top of bulkheads 111. Upper rail 112 has a width of about three feet and extends the entire length of car 101 between ends 103. Upper rail 112 comprises structural steel tubing and sheet formed in an angled or rounded gutter. A plurality of spaced apart transverse members 201 span across upper rail 112 at regular intervals. Key holes 202 are formed in each end of transverse members 201. Key holes 202 are designed to receive and removeably couple to one end of a cable 113 used to secure load 114 during transport.

Figure 4:
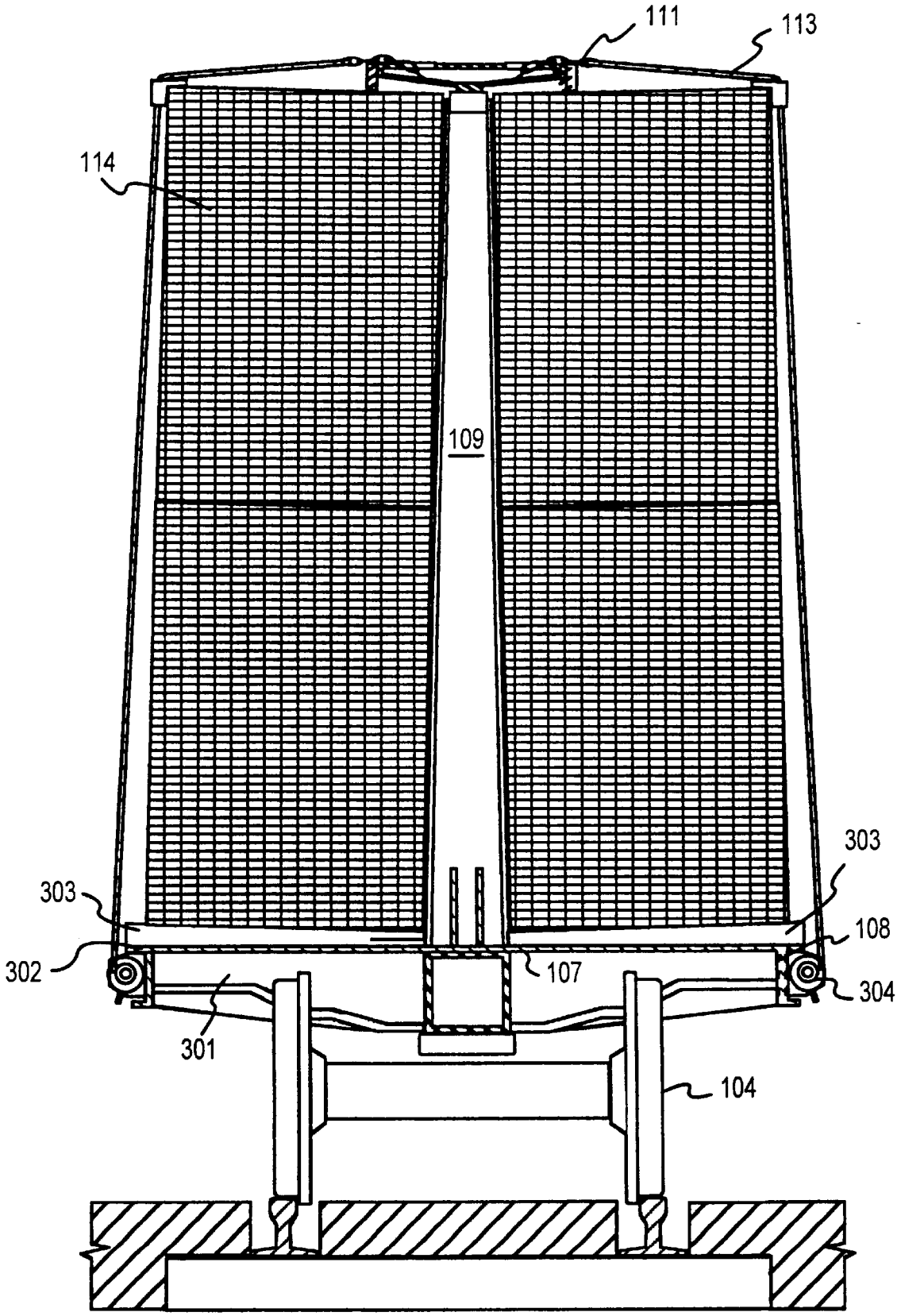
FIG. 4 shows a cross-section view through the middle of a loaded center beam flatcar.

As seen in the cross-section view of FIG. 4, cargo 114 is supported by cross-bearing members 301 attached to or formed integrally with center sill 107 and side sills 108. A deck sheet 302 forms a floor of flatbed car 101. A riser 303 formed of sheet steel provides a cargo-supporting top surface sloped slightly toward center beam 109. Cargo 114 is secured by cables 113 extending from upper rail 112 to winches 304 mounted on side sill 108. Cables 113 are tightened and loosened as needed during loading and unloading of cargo 114 using winches 304 that may be hand or motor powered winches to meet the needs of a particular application.

Figure 5:
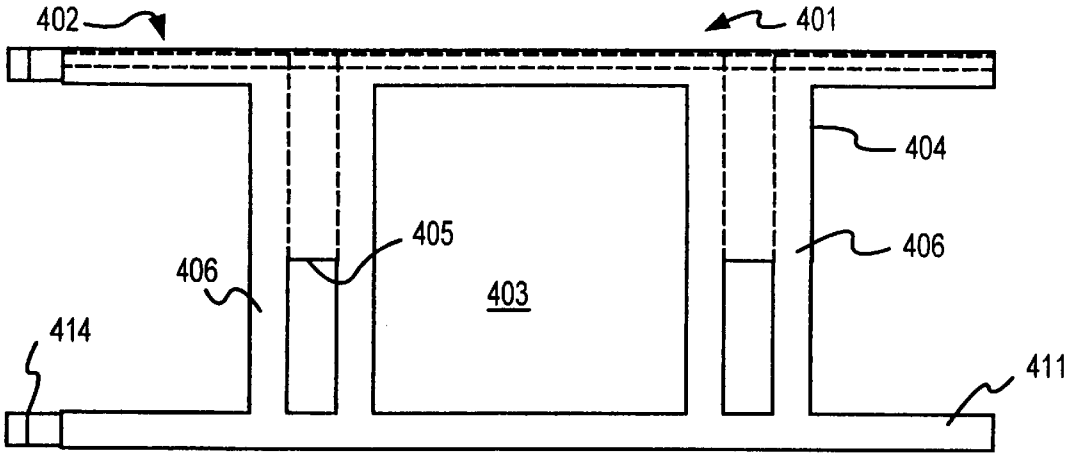
FIG. 5 illustrates a top-down view of an exemplary configuration of the present invention.
Figure 7:
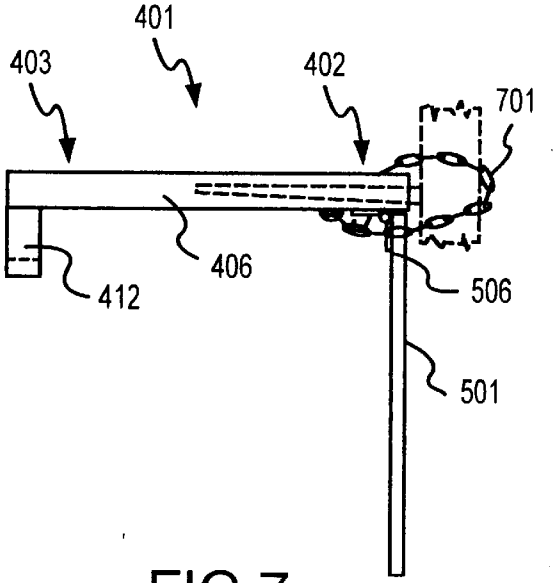
FIG. 7 shows a side view of the embodiment shown in FIG. 6.
Figure 6:
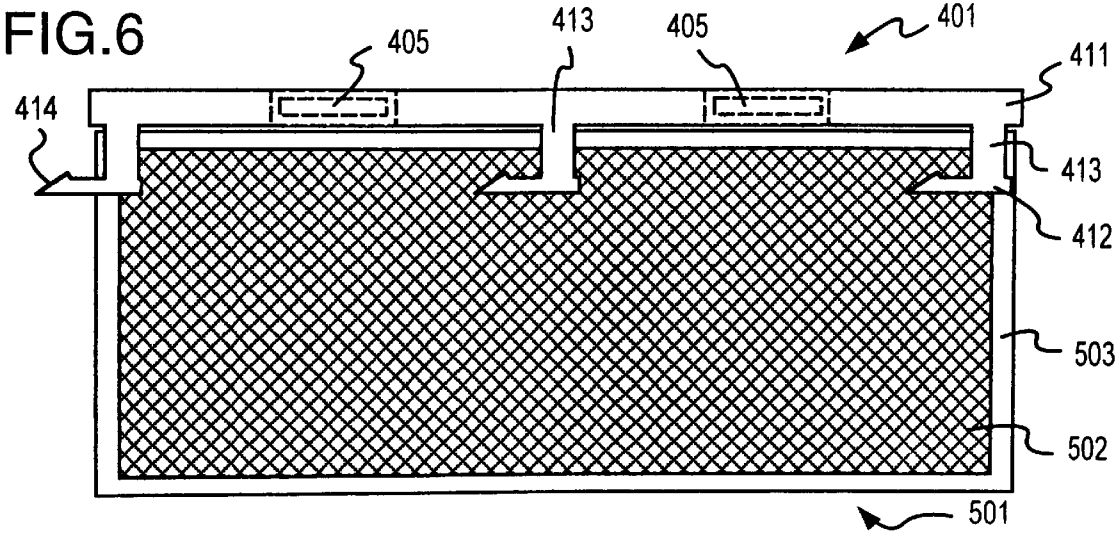
FIG. 6 shows a front-to-back view of an embodiment of the present invention.
Figure 9:
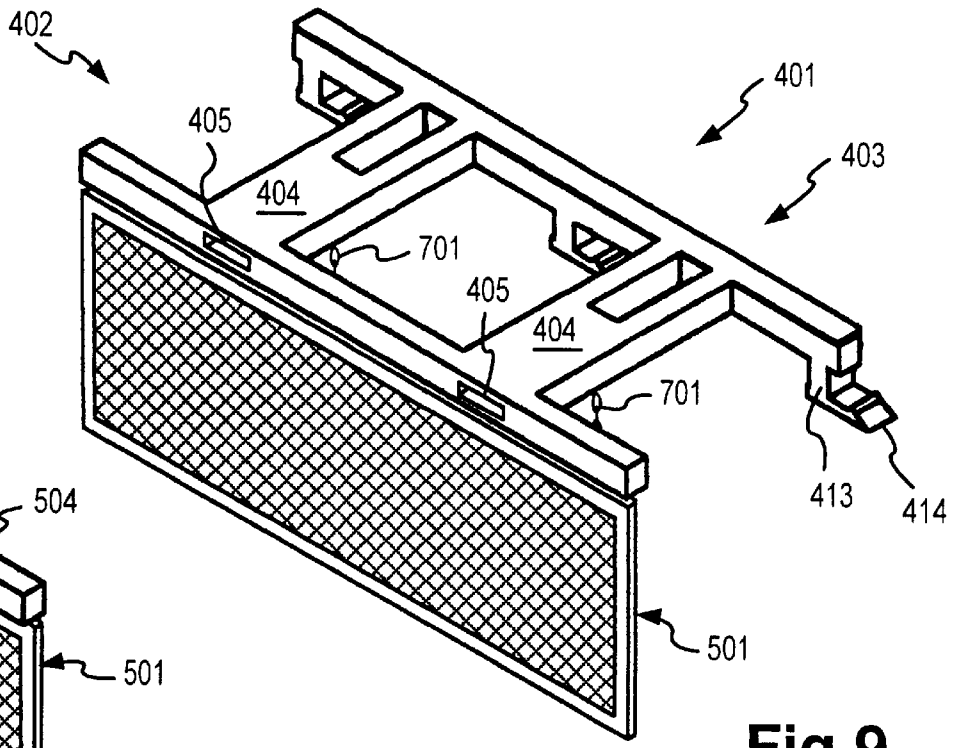
FIG. 8 and FIG. 9 illustrate perspective views of a cable removing apparatus in accordance with the present invention.
Figure 8:
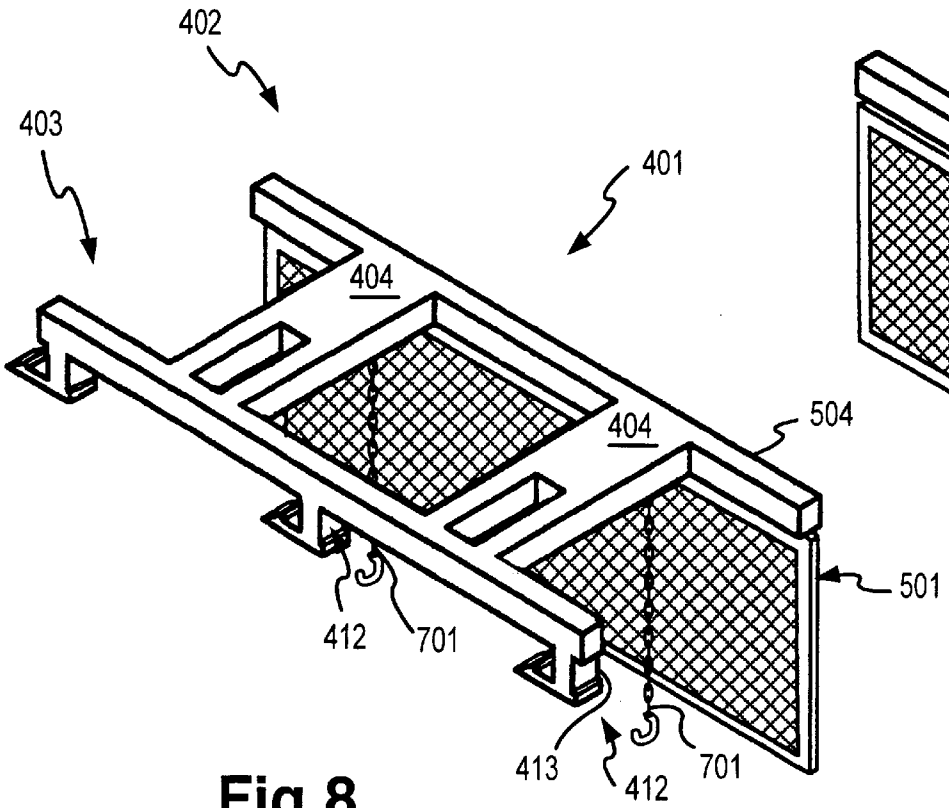

FIG. 5, FIG. 6 and FIG. 7 illustrate plan views of the cable removing mechanism 401 in accordance with the present invention. FIG. 5 illustrates a top-down view of an exemplary configuration of the present invention. FIG. 6 shows a front-to-back view of an embodiment of the present invention. FIG. 7 shows a side view of the embodiment shown in FIG. 6. FIG. 8 and FIG. 9 show perspective views of the mechanism 401 shown in FIGS. 5–7. The various features are best understood with reference to FIG. 5 through FIG. 9 together. It must be understood that many variations to the physical structure, appearance, and materials used will be readily apparent. For example, the preferred embodiments are made using tubular steel and sheet steel joined together by welds. However, other materials including other rigid metals, composite materials, and even plastics or ceramics may be substituted without departing from the basic teachings of the present invention. Likewise, the preferred embodiment is adapted to be manipulated using a conventional forklift, but any available lift mechanism including tractors, hand operated lifts, and overhead lifts and cranes may be substituted without departing from the present invention.

Cable removing mechanism 401 comprises a receiver end 402 adapted to couple to a lift mechanism and a claw end 403 adapted to remove cable tie downs from key hole slots 202 shown in FIG. 2. Receiver end 402 is attached to claw end 403 by welding, for example. It is contemplated that other attachment and fabrication techniques will provide suitable results. Although cable removing mechanism 401 is preferably fabricated from high strength structural steel for durability, the relatively low load placed on the operating components is adaptable to lower strength materials to reduce weight and manufacturing cost.

Receiver end 402 comprises two receivers 404 where each receiver defines a cavity 405 sized to allow one tine of a fork lift to slide in and out without binding. Each receiver 404 is formed in the example by a pair of substantially parallel 3" rectangular cross section tubular steel bars 406. The two bars 406 are, for example, about four feet long and spaced apart sufficiently to accommodate the width of the forklift tine. The upper and lower bounds of cavity 406 are defined by, for example, ½ sheet steel welded along the upper surface of at least a portion of bars 406. Sheet steel portions may extend along the entire length of bars 406, or along only a portion as shown in FIG. 4 to meet the needs of a particular application. The specific size and thickness values disclosed herein are for illustrative purposes only and are not intended to be a limitation of the present invention.

Claw end 403 comprises a claw bar 411 attached to a plurality of claw assemblies 412. Each claw assembly 412 corresponds to a cable 113 that can be removed in one pass during operation. In other words, the three claw assemblies 412 enable cable removing mechanism 401 to remove up to three cables 103 simultaneously. A greater or lesser number of claws can be provided to meet the needs of a particular application.

Claw bar 411 is approximately ten feet long in the particular example and comprises 3" tubular steel having a rectangular cross section. Claw bar 411 is attached to each receiver 404 by welding or other equivalent fabrication technique. Receivers 404 extend horizontally away from claw bar 411 so that the receiver end in which the fork lift tines are inserted is located distally from the claw bar 411.

Claw assemblies 412 are attached to or integrally formed with claw bar 411 in an aligned, spaced apart arrangement. The spacing between adjacent claw assemblies 412 is chosen to correspond to the spacing between cables 103 on a center beam railcar 101 to be unloaded. Accordingly, claw assemblies 412 will typically, but not necessarily, be uniformly distributed along claw bar 411.

Each claw assembly 412 comprises a downtube 413 and a hook portion 414. The downtube 413 is rigidly affixed to both the claw bar 411 and the hook portion 414. Downtubes 413 comprise about 6" long sections of 3" tubular steel having a rectangular cross section. Hook portions 414 have a flat end that attaches to the corresponding downtube 413 and a tapered end located distally from the flat end. The tapered end is given sufficient taper to aide in engaging cables 103 during operation, and in some instances may have little or no taper. Hook portions 414 all extend laterally away from their respective downtubes 413 in the same direction so that the taper ends all point in the same direction. In FIG. 4 the taper ends point to the left of the page, however an equivalent implementation is enabled if all the taper ends point to the right of the page.

Optionally the invention is implemented with a safety screen assembly 501. Safety screen assembly 501 protects a lift operator working below the cable removing device 401 from injury caused by cables 113 flying off the top of car 101 once disengaged from key holes 202. As the cables 113 are typically several feet long comprising heavy steel, they present a serious risk of injury when falling. Safety screen assembly 501 comprises a generally rectangular shaped screen 502 comprising any material that does not unacceptably block the operators line of sight yet provides protection from the falling cables 113. In a particular implementation, safety screen assembly 501 is about ten feet wide and about three to four feet high. A steel screen or mesh is used in the particular implementation, but transparent plastics, netting, and the like may be readily substituted as equivalents.

Screen 502 is supported by frame 503 comprising 1" diameter tubular steel having a rectangular cross section in the preferred implementation. Frame 503 can also be made from lighter weight materials and can be eliminated in cases where the material chosen for screen 502 is self supporting. Frame 503 is attached by hinges 506 to screen bar 504. Hinges 506 enable screen 502 to swing down in operation (i.e., when the cable remover assembly 401 is lifted off the ground) and to store neatly beneath receivers 404 when the cable remover mechanism 404 is on the ground. Screen bar 504 comprises a bar of structure steel tubing having, for example, a 3" diameter and approximately ten foot length. Screen bar 504 is attached by welding or an equivalent fabrication process to the under side of each receiver 404 at about 12" from the receiver end 402.

Figure 10:
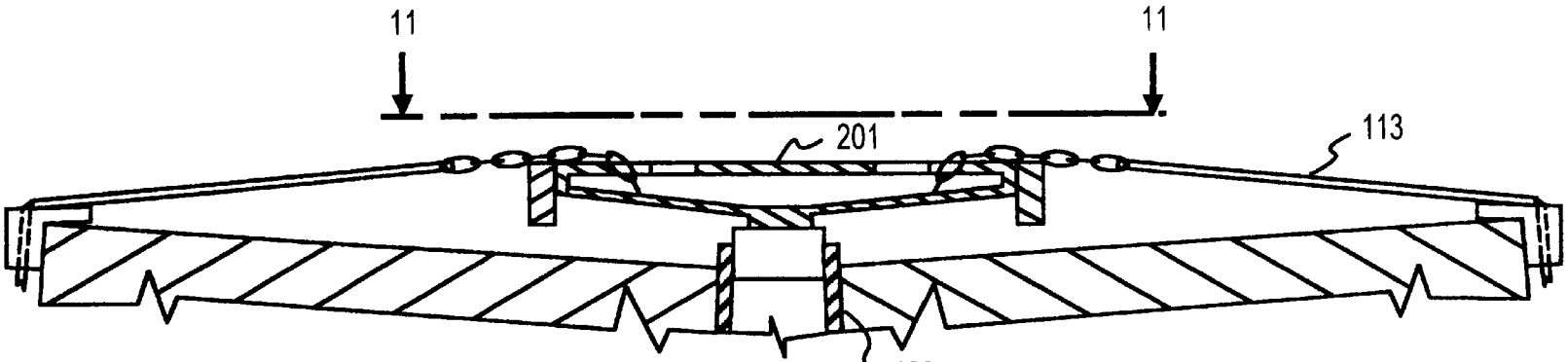
FIG. 10 illustrates a top portion of a rail car in which the present invention is operable.
Figure 11:
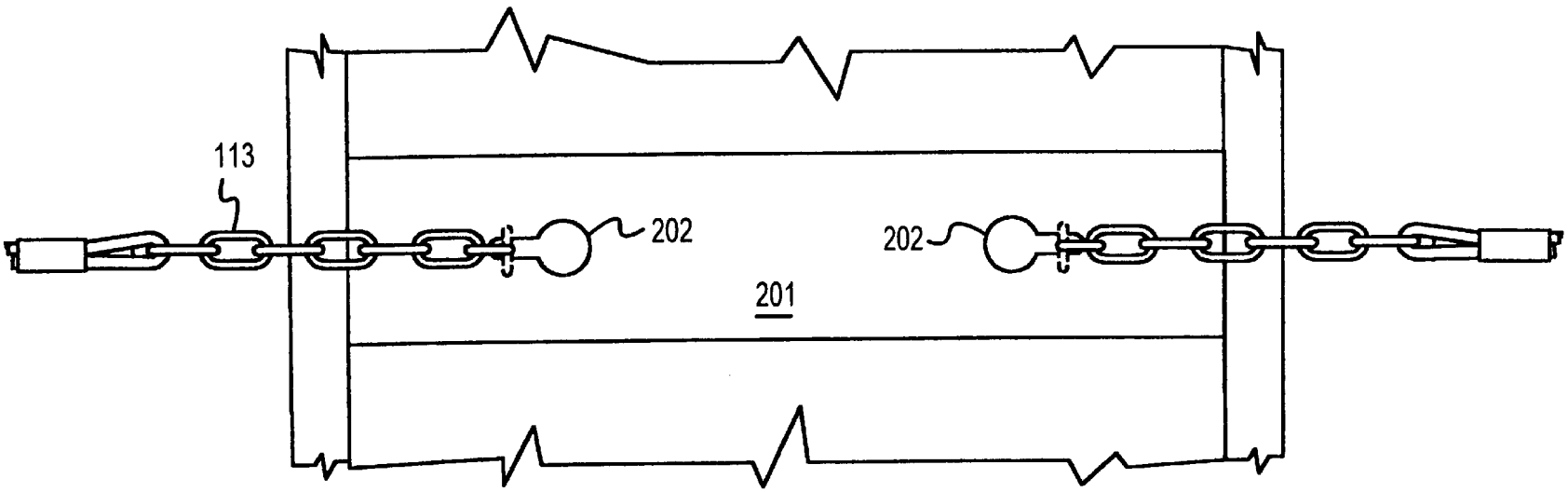
FIG. 11 illustrates a top-down view of a portion of FIG. 10.

FIG. 10 illustrates a top portion of a rail car in which the present invention is operable while FIG. 11 illustrates a top-down view of a portion of FIG. 10. These figures show enlarged views of what is shown and described in reference to FIG. 1, FIG. 2 and FIG. 3 to ease understanding. Essentially, cable 113, includes an end such as a chain that adapts to fit into a removeably locking relationship with keyholes 202. Cable 113 is taut when transporting a load.

Figure 12:
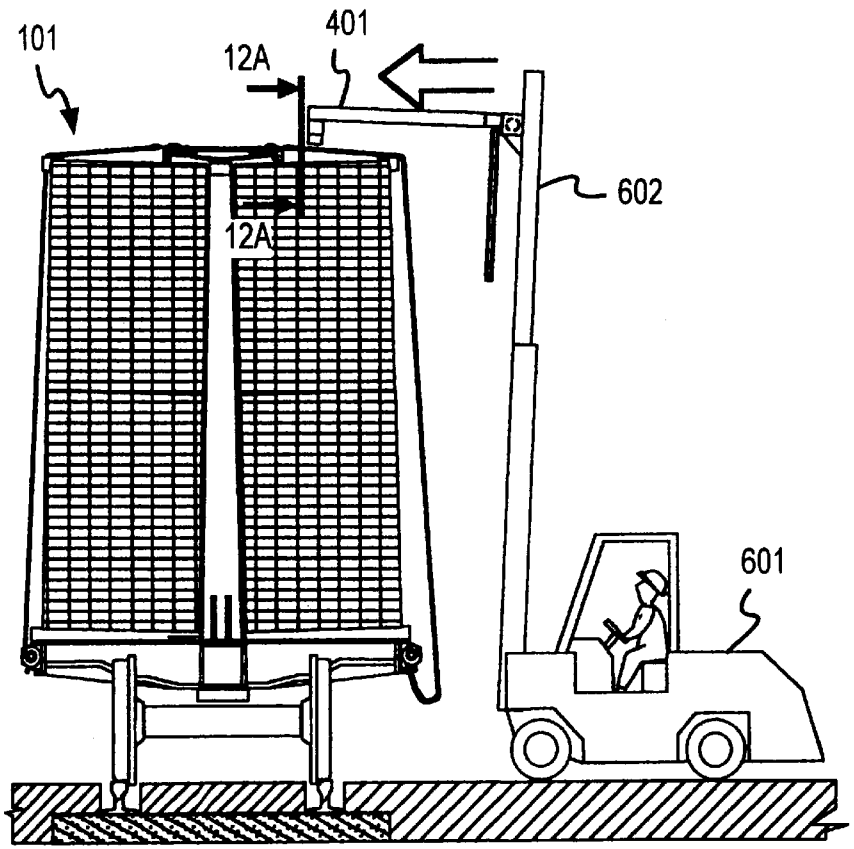

FIG. 12–FIG. 19 illustrate a typical method of using the cable removing apparatus 401. As shown in FIG. 12, safety gate assembly 501 is sized and hinged so as to fold under cable remover 401 when positioned on the ground or other flat surface. Initially, a forklift 601 is positioned with its mast 602 in a lowered position and the fork times aligned with cavities 405. Forklift 601 drives its fork times into the receiver cavities 405 as shown in FIG. 12.

Desirably, the receiving end 402 is equipped with optional safety chains 701 (shown in FIG. 7–FIG. 9) affixed to any convenient position on cable removing mechanism 401. The safety chains 701 are wrapped around a portion of mast 602 to prevent mechanism 401 from falling from the tines of forklift 601 in operation. Similarly, a second safety chain (not shown) can be used to secure safety gate assembly 501 in a closed position during storage and non-use. Although these features are not specifically illustrated they are readily implemented using available mechanisms and assembly techniques.

In operation, cables 113 are typically loosened prior to loading the cable remover mechanism 401 onto lift 601. It is recommended that cables 113 be loosened as much as permitted by the winch mechanism to prevent binding of cable 113 when removed. Even when tightened there is a small space between the top of cargo 114 and some portion of cables 113, and this space is increased when cables 113 are loosened. This space allows the hook ends 414 of claw assemblies 412 to be inserted underneath the loosened cables 113 and above cargo 114.

Figure 13:
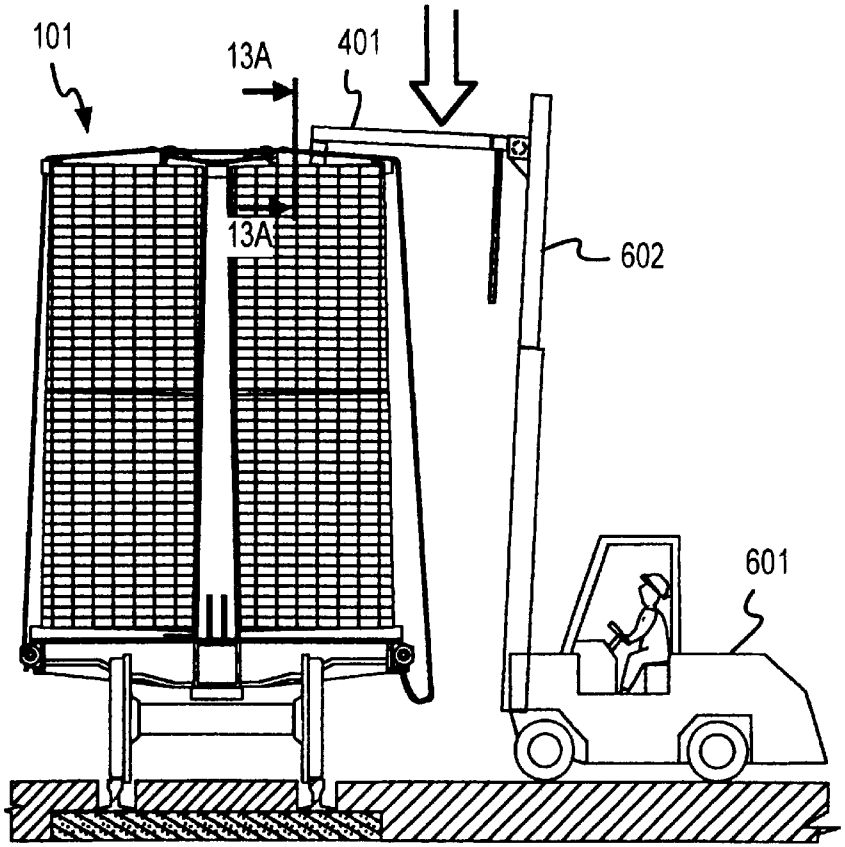
FIG. 12–FIG. 19 illustrate various stages in a method in accordance with the present invention.
Figure 12A:
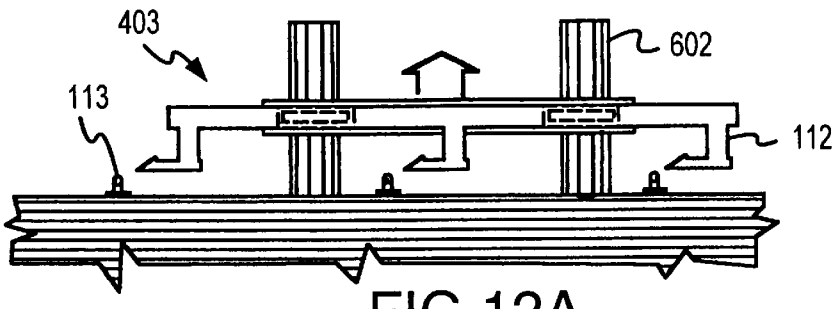
Figure 13A:
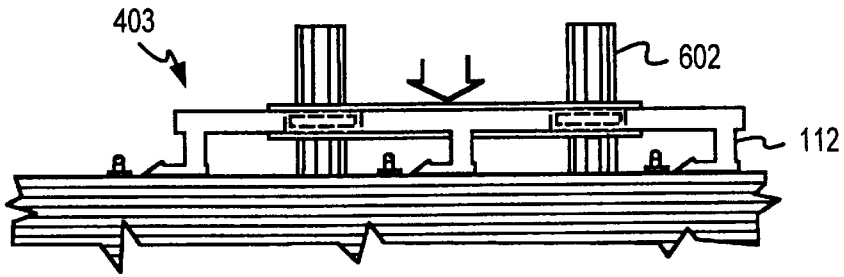

Once the cables are loosened, the remainder of the process in accordance with the present invention can be completed while the operator remains in the safety of lift 601. Mast 602 is raised to a level that places claw end 403 a few inches, for example 2–6 inches, above the top of load 114. Forklift 601 is then driven forward as suggested in FIG. 12 and roughly aligned to cables 113 such that the open hook end 414 of each claw assembly 412 is a few inches to the side of a corresponding cable 113 as shown in FIG. 12A. The claws are aligned to the left of cables 113 in the particular example due to the direction of hook ends 414. Claws aligned to the right of cables 113 would be appropriate if the direction of hook ends 414 were reversed. Further rough positioning may be accomplished as shown in FIG. 13 and FIG. 13A to lower the claws into vertical alignment beneath cables 113.

Figure 14A:
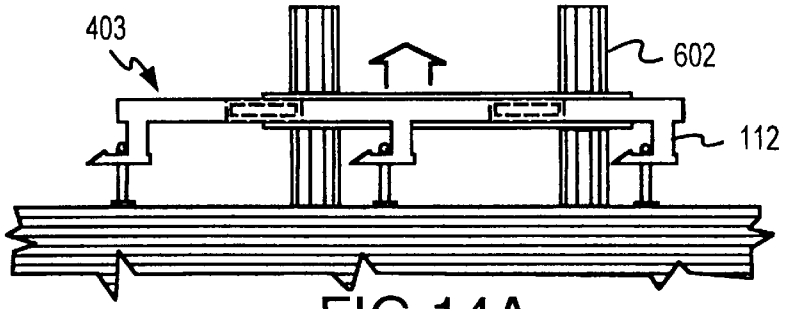
Figure 13B:
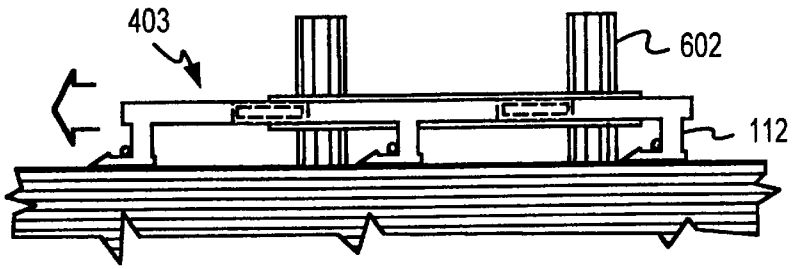
Figure 14:
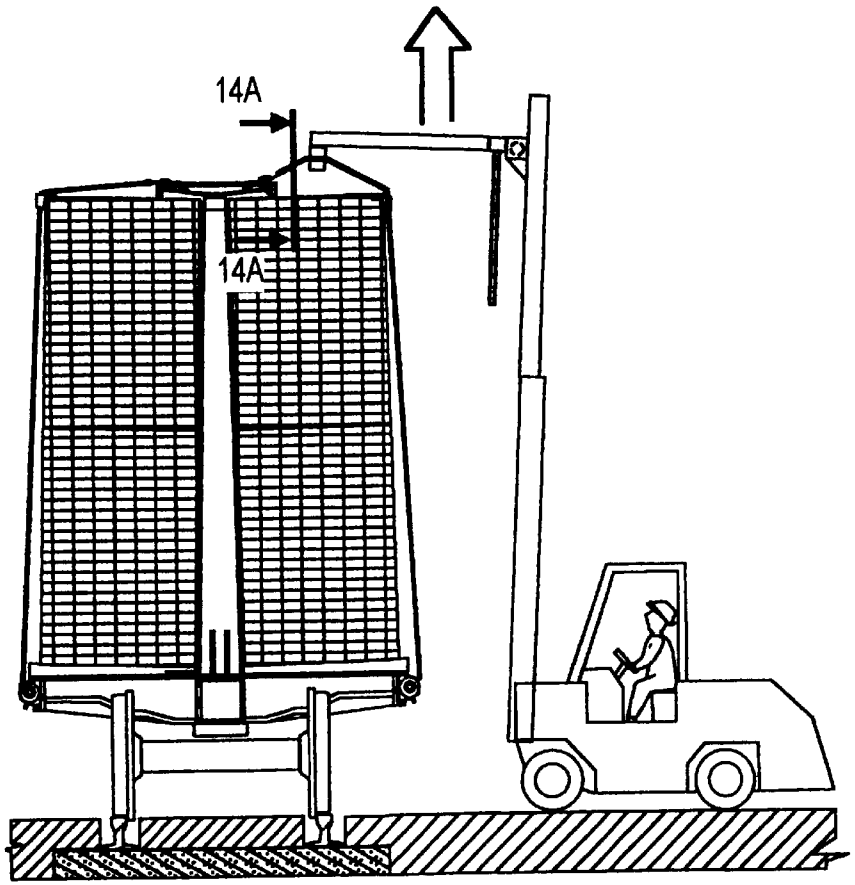
Figure 17A:
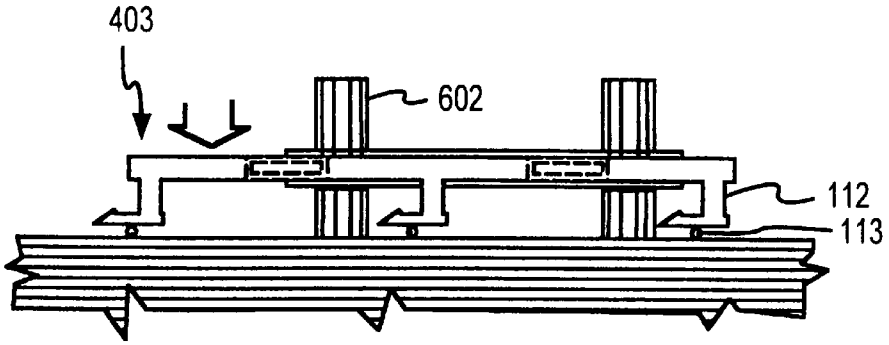

Once the rough alignment is completed, the cable removing mechanism 401 is side-shifted as shown in FIG. 13B using lift 601 to maneuver the hook ends 414 into position between the top of cargo 114 and cables 113. It is useful at this stage to raise mast 602 slightly as shown in FIG. 14 and FIG. 14A while visually checking cables 113 to verify proper engagement between cables and claw assemblies 412. Proper engagement means that cables 113 are aligned to engage claw assemblies 412 at a position that will support the force required to disengage the cables 113 from key holes 202.

Figure 15A:
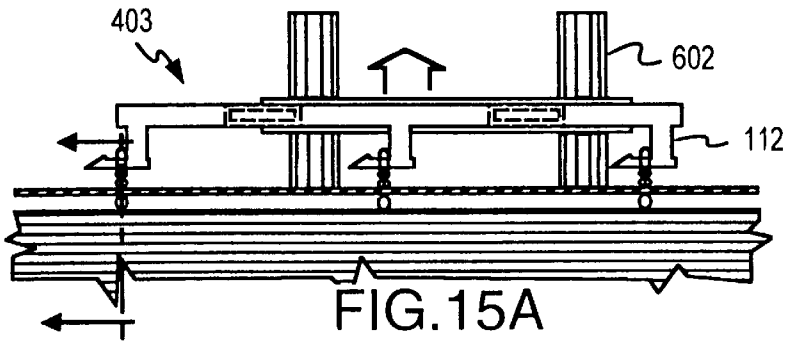
Figure 15B:
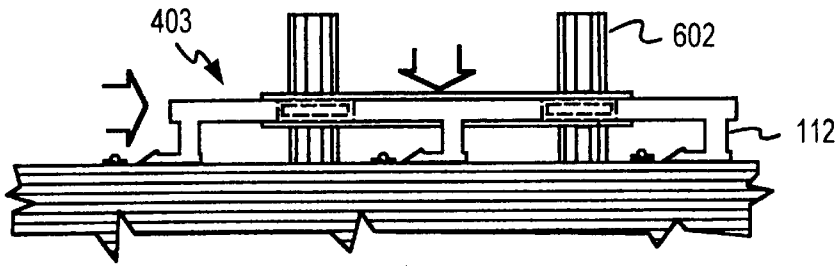
Figure 15:
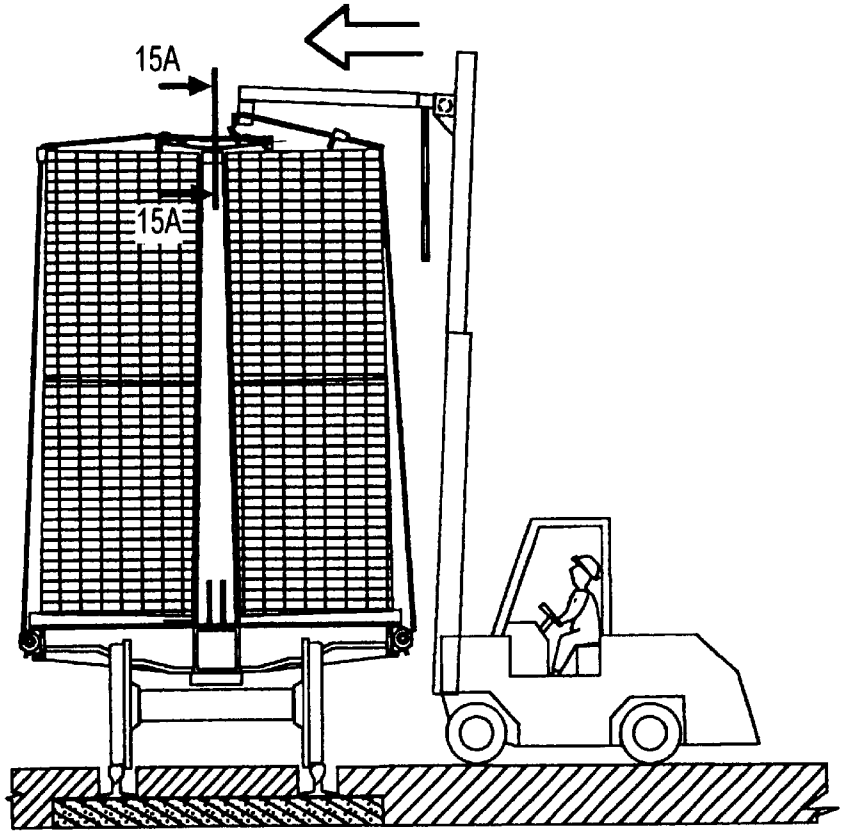
Figure 15C:
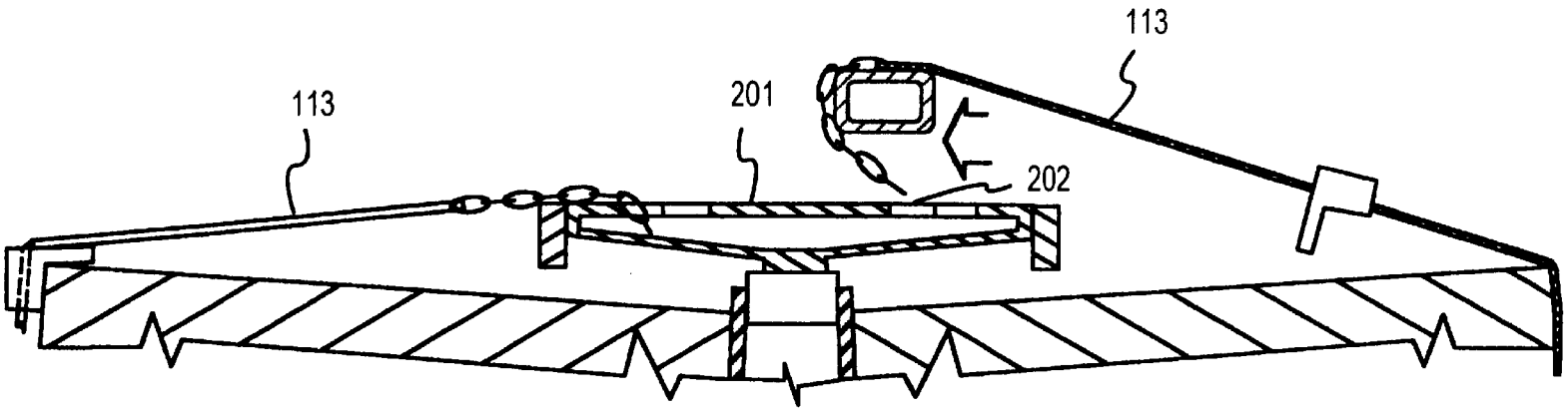
Figure 17:
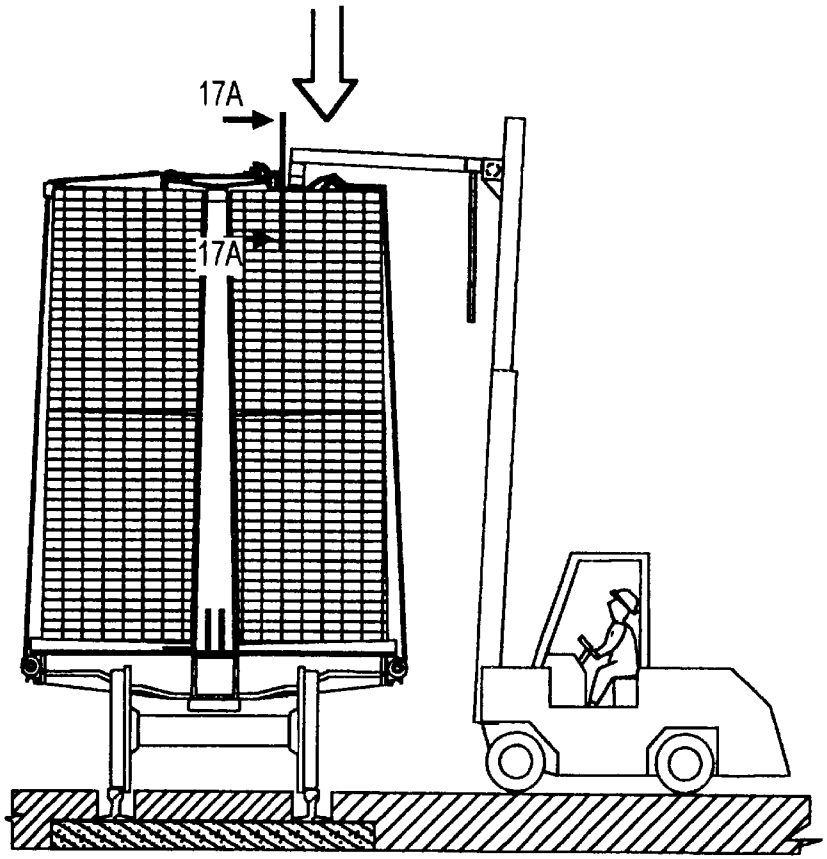
Figure 16:
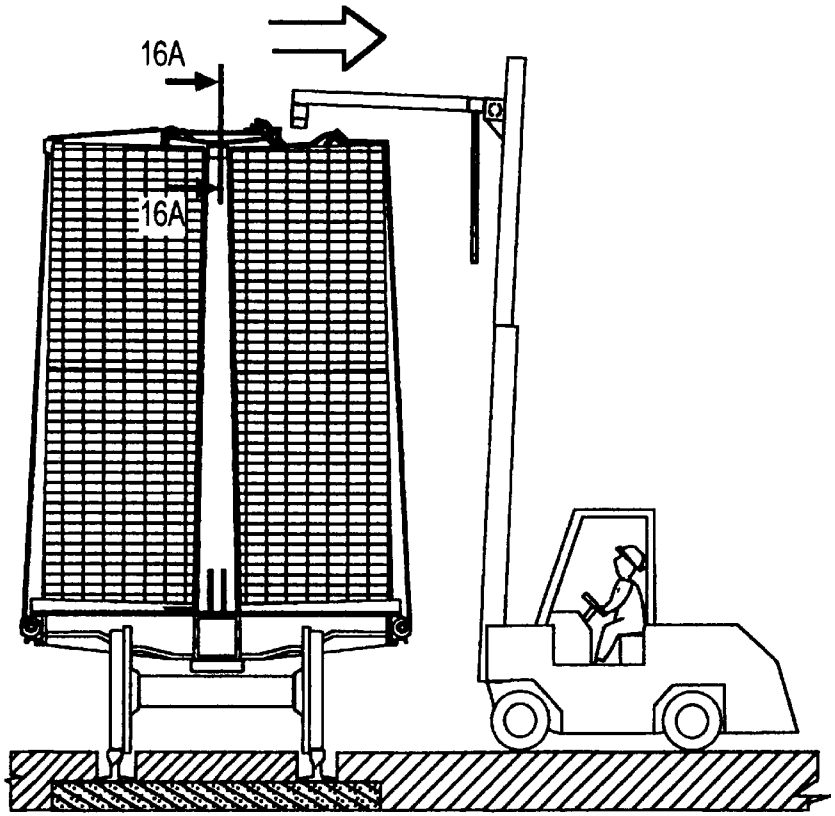
Figure 19:
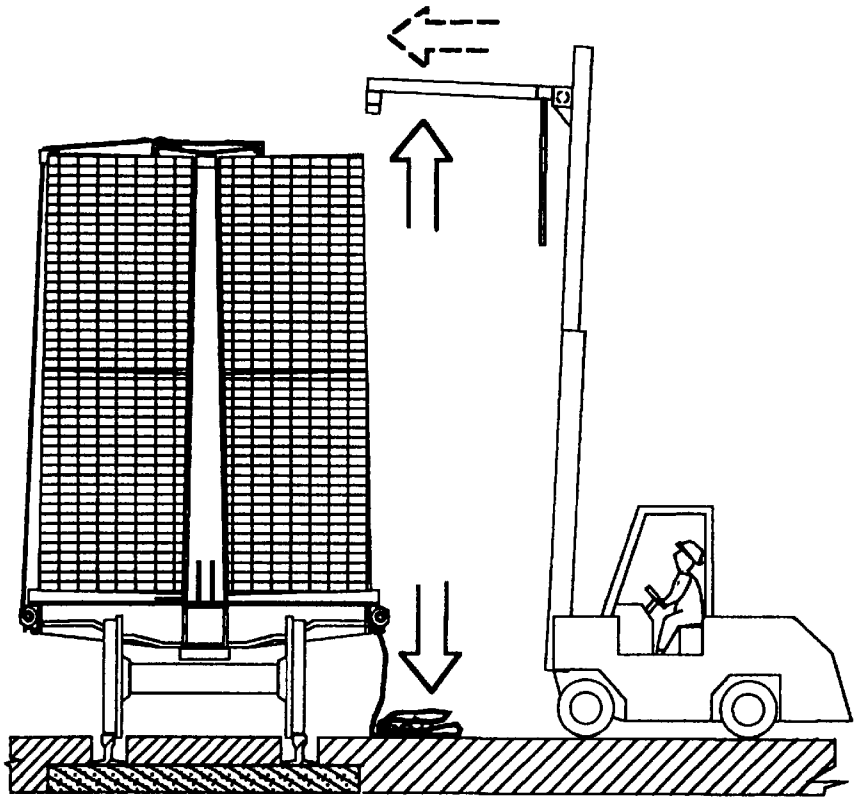
Figure 18:
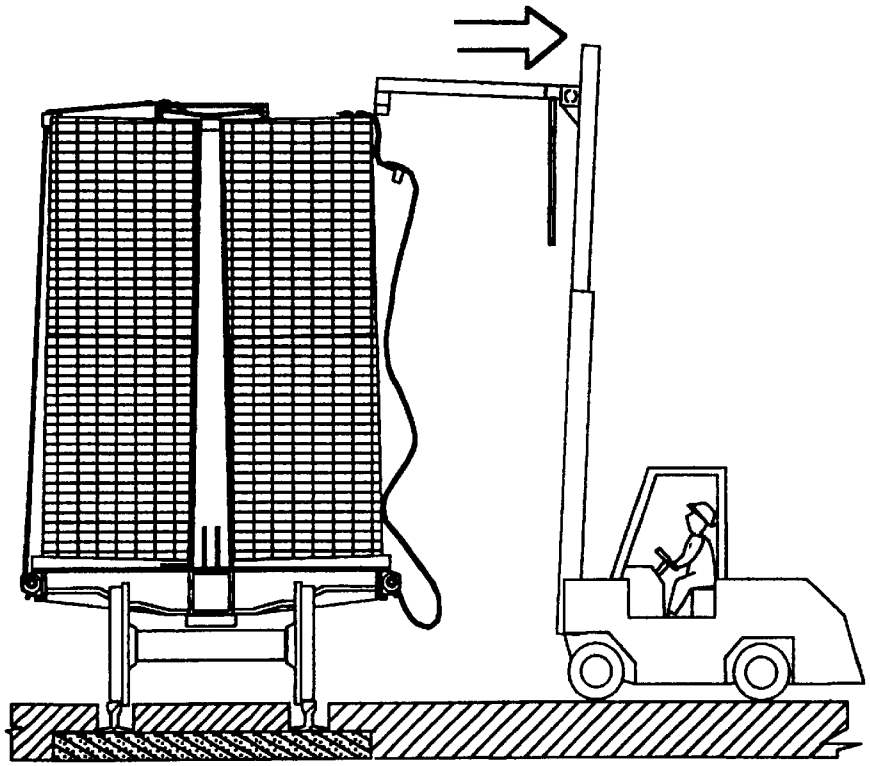

Once engagement and position is visually verified, mast 602 is raised once again to lift claw assemblies 412 clear of the upper rail 112 as shown in FIGS. 15 and 15A. A few inches clearance (i.e., two to four inches) is all that is required and a wide tolerance is permitted at this stage. The process in accordance with the present invention is completed by driving the lift 601 forward (i.e., towards car 101) as suggested in FIG. 15 until ends of cables 113 are pushed forward in key holes 202 to release the cables. Detail of this operation is shown in FIG. 15C. Cables 113 will either fall immediately of their own weight (e.g., as shown in FIG. 15B and FIG. 19), or may need to be removed by backing lift 601 away from car 101 until the cables fall free to the ground as shown in FIG. 16, FIG. 17, FIG. 17A and FIG. 18. In either case, safety screen assembly 501 prevents operator injury from the falling cables.

The steps discussed above are repeated for each set of cables 113 on both sides of car 101. In practice the operations can be performed safely in about fifteen to twenty minutes per car 101 using a single operator. It is contemplated that with skill and experience this time can be improved.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

What is claimed is:

1. A method for removing cable tie downs from a center beam railcar having an upper beam to which cable ends of the cable tie downs are removably attached, the method comprising the steps of:

loosening a cable tie down to create cable slack;

attaching a cable removing apparatus to a lift mechanism having a cable claw located distally from the lift mechanism, the cable claw being rigidly mounted within the cable removing apparatus and including an open hook end rigidly mounted and configured to receive and contact cable tie downs;

engaging a portion of the loosened cable tie down with the cable claw using the lift mechanism to position the cable claw adjacent the loosened cable tie down and moving the cable claw substantially parallel to the upper beam, whereby the loosened cable tie down is received into the open hook end of the cable claw; and moving the cable removing apparatus with the cable claw towards the upper rail of the center beam railcar until the cable tie down engaged by the cable claw is released from a keyhole in the upper rail.

2. The method of claim 1 wherein the step of engaging comprises:

positioning the cable claw so that a tip end of the open hook end is adjacent to the loosened cable tie down and clear of cargo carried in the railcar; and side shifting the cable claw in the direction of the cable tie down such that the tip end enters a space between the cargo and the cable tie down created by the cable slack.

3. The method of claim 1 further comprising the step of lifting the cable claw above the upper rail of the center beam railcar before the step of moving the cable removing apparatus towards the upper rail.

4. The method of claim 1 further comprising:

moving the cable removing apparatus with the cable claw away from the upper rail until the released cable tie down is pulled free of the railcar and falls to the ground.

5. The method of claim 1 further comprising the step of deploying a safety screen between the lift mechanism and the cable tie downs.

6. The method of claim 1 wherein the step of attaching the cable removing apparatus further comprises the step of securing the cable removing apparatus to the lift mechanism using a chain tie down.

7. An apparatus for removing tie down cables from a center beam rail car loaded with cargo, the apparatus comprising:

a support beam having a width selected to be greater than the span between a number of tie down cables on the center beam rail car;

a plurality of hook-shaped cable claws rigidly attached in a spaced apart, downwardly extending manner to the support beam, wherein the cable claws include a hook end having an opening for receiving the tie down cables and being in a plane substantially parallel to the support beam; and at least one lift sleeve with a longitudinal axis transverse to the support beam rigidly attached to the support beam and having a receiving end for attaching to an external lift mechanism.

8. The apparatus of claim 7 wherein the cable claws are spaced from each other by a spacing substantially similar to cable-to-cable spacing in center beam flatcars.

9. The apparatus of claim 7 wherein the cable claws comprise:

a down tube welded to the bottom of the support beam; and the hook ends are welded to the bottom of the down tube and extend away from the down tubes in a direction parallel to the support beam.

10. The apparatus of claim 9 wherein the hook end of each cable claw extends away from the corresponding down tube in a single direction.

11. The apparatus of claim 7 wherein the lift sleeve comprises a pair of parallel spaced apart tubular steel bars attached to each other by a plate of sheet steel.

12. The apparatus of claim 7 further comprising at pair of lift sleeves adapted to receive the tines of a fork lift.

13. The apparatus of claim 7 further comprising a safety gate attached by hinges to the cable removing apparatus near a receiving end of the at least one lift sleeve.

14. An unloading system for a center beam flatcar comprising:

a center beam railcar having a deck with a cargo loaded thereon, the center beam railcar having an upper rail extending along the top of the center beam, a plurality of key holes formed in the upper rail, and a plurality of winches attached to the deck;

a plurality of cables securing the cargo, each cable having a first end coupled to one of the key holes and a second end attached to one of the winches;

a lift mechanism with a lift member movable in vertical and horizontal directions; and a cable removing mechanism that removably attaches to the lift mechanism, wherein the cable removing apparatus includes a plurality of spaced apart aligned cable hooks positioned at a first end having a hook end with an opening in a plane transverse to a longitudinal axis of the lift member and a lift mechanism receiver located at a second end and wherein the cable hooks extend downwardly a sufficient distance to engage a loosened cable tie down from above the load.

15. The system of claim 14 herein the lift mechanism comprises a forklift and the lift member comprises a fork lift tine.

16. A cable removing device for use in detaching an end of a tie down cable from a center beam flatcar, wherein the center beam flatcar includes an upper rail with a plurality of transverse members having key holes for receiving and removably coupling to the end of the tie down cable when a load is bound to the center beam flatcar, comprising:

a receiver end comprising a cavity configured for receiving a lifting member of a lift mechanism, wherein the received lifting member abuttingly contacts the cavity to vertically and horizontally position the cable removing device relative to the center beam flatcar; and a claw end comprising a claw bar connected to the receiver end on a side distal to the cavity, wherein the claw end further comprises a first claw assembly including a downtube rigidly attached to the claw bar and extending transverse to the claw bar and a hook portion rigidly attached to the downtube configured for receiving and contacting the tie down cable, the hook portion comprising a contact member extending laterally away from the downtube to form an open end in a plane transverse to an axis of the lift member;

wherein the open end of the first claw assembly is configured for initially receiving and contacting the tie down cable with the downtube acting as a horizontal load bearing member when the lift mechanism is operated to move the lifting member in a direction substantially parallel to the upper rail of the flatcar.

17. The device of claim 16, wherein the contact member includes a flat end proximal to the downtube and a tapered end distal to the downtube for engaging the tie down cables and guiding the tie down cables into the claw assembly, whereby the tie down cables abuttingly contact the downtube when the lifting member is moved in a direction substantially parallel to the upper rail of the flatcar and abuttingly contact the flat end when the lifting member is moved in a direction traverse to the upper rail.

18. The device of claim 17, wherein the claw end comprises a second claw assembly rigidly attached to the claw bar with a tapered end and a flat end forming a second open end positioned to open in a same direction as the first claw assembly and to be positioned substantially in the same plane as the open end of the first claw assembly.

19. The device of claim 18, wherein the first claw assembly and the second claw assembly are a separation distance apart as measured along an axis of the claw bar, the separation distance being about a separation distance between key holes in adjacent ones of the transverse members, whereby the first and second claw assemblies are operable to concurrently engage and detach a first and a second, adjacent tie down cable.

20. The device of claim 16, wherein the downtube of the claw assembly is tubular steel with a rectangular cross section selected to resist shearing.

21. The device of claim 16, wherein the receiver end has a length of at least about 4 feet as measured along an axis of the cavity.

22. The device of claim 16, further comprising a safety screen assembly including a frame rotatably attached to a portion of the receiver end proximal to the cavity and a screen attached to the frame configured to block passage of the tie down cable, wherein the frame is free to rotate downward due to gravity into a plane transverse to a plane passing through the receiver end.

23. The device of claim 1, wherein the cable removing apparatus comprises a plurality of the cable claws rigidly mounted with each having the open hook end aligned and opening in the same direction and being spaced apart in the cable removing apparatus a distance selected to approximate distances between adjacent locations on the upper beam for removably attaching the cable ends of the cable tie downs and further wherein the attaching and engaging steps are performed concurrently for each of the cable claws.

* * * * *